US007205506B1

(12) United States Patent
O'Donnell

(10) Patent No.: US 7,205,506 B1
(45) Date of Patent: Apr. 17, 2007

(54) GLOW PLUG WITH HEAT RANGE INDICATIVE COLOR

(76) Inventor: Steven B. O'Donnell, 10702 Hathaway Dr., #2, Santa Fe Springs, CA (US) 90670

( * ) Notice: Subject to any disclaimer, the term of this patent is extended or adjusted under 35 U.S.C. 154(b) by 11 days.

(21) Appl. No.: 10/965,443

(22) Filed: Oct. 13, 2004

(51) Int. Cl.
*F23Q 7/22* (2006.01)

(52) U.S. Cl. ..... 219/270; 219/541; 219/544; 123/145 A; 123/145 B

(58) Field of Classification Search ..... 219/541, 219/544, 270; 123/145 A, 145 B; 301/264, 301/265, 266; 428/472.2
See application file for complete search history.

(56) References Cited

U.S. PATENT DOCUMENTS 2,030,937 A * 2/1936 Reichmann ..... 123/145 A
4,620,512 A * 11/1986 Brooks et al. ..... 123/145 A
5,486,283 A * 1/1996 Mnich ..... 205/174
6,346,688 B1 2/2002 O'Donnell ..... 219/270
6,696,670 B1 2/2004 O'Donnell ..... 219/270

FOREIGN PATENT DOCUMENTS

JP 01095221 * 4/1989

OTHER PUBLICATIONS

Duratrax catalog , Sep. 2001.*
MIL-A-8625F, Sep. 1993.*

* cited by examiner

*Primary Examiner*—Robin Evans
*Assistant Examiner*—Leonid Fastovsky
(74) *Attorney, Agent, or Firm*—Kenneth E. Green; Edgar W. Averill, Jr.

(57) ABSTRACT

A glow plug having a heat range indicated by a colored insulating ring. The insulating ring, along with first and second washers, insulates a central electrode from a glow plug body. Electrical insulation is provided by anodizing the insulating ring. A colored anodizing is used on the insulating ring which is visible from the top of the glow plug, which colored anodizing is indicative of the heat range of the glow plug.

19 Claims, 3 Drawing Sheets

GLOW PLUG WITH HEAT RANGE INDICATIVE COLOR

The present application claims the benefit of U.S. patent application Ser. No. 10/781,279, filed Feb. 17, 2004, which application is incorporated herein by reference.

BACKGROUND OF THE INVENTION

The present invention relates to glow plugs and more particularly to a high performance glow plug including a heat range indicative colored insulator for use in hobby engines, and particularly in small high performance engines.

One popular form of model car competition is tether racing supported by groups such as the American Miniature Racing Car Association (AMRCA). Tether racing has existed since the 1930's, and the speed and sophistication of the cars and engines has steadily grown. Internal combustion engines used to power model cars, planes, and boats have been refined to an extent that tethered model cars can exceed 200 mph. One important aspect of tuning such internal combustion engines is the selection of a glow plug with the correct heat range. The heat range of the glow plug controls the temperature of the glow plug, and as many as twelve steps in heat range are commonly available. A hotter plug (one with a lower heat range designation) will ignite the fuel in the engine sooner, and a colder plug will ignite the fuel later, thereby affecting the ignition point of the engine. The fuel being used, and other factors such as the exhaust system, also affect the ignition point. All of these engine variables must cooperate to obtain optimal power from the engine. As a result, it is important that the glow plug perform properly, and that the correct heat range glow plug is used.

Various improvements in glow plug construction have been made to ensure proper function is high stress environments. Example of modern glow plugs having such improvements are shown in U.S. Pat. No. 6,346,688 for "Glow Plug with Crimp-secured Washer and Method," U.S. Pat. No. 6,696,670 for "Glow Plug with Tightly-fit Electrode," and U.S. patent application Ser. No. 10/781,279 for "Glow Plug," all having the same applicant as the present application. The '688 patent and the '670 patent are incorporated by reference herein.

Because the small size of glow plugs makes marking difficult, and the stress of preparation for competitive events, there is a likelihood of installing an incorrect heat range glow plug. Because of the extreme environments glow plugs must survive, such as in tethered racing where the lower end of a glow plug can reach in excess of 1000 degrees Fahrenheit, markers such as a colored plastic ring will not survive. A method is thus needed for identifying the heat range of glow plugs, which method can survive harsh environments.

BRIEF SUMMARY OF THE INVENTION

The present invention addresses the above and other needs by providing a glow plug having a heat range indicated by a colored insulating ring. The insulating ring, along with first and second washers, insulates a central electrode from a glow plug body. Electrical insulation is provided by anodizing the insulating ring. A colored anodizing is used on the insulating ring which is visible from the top of the glow plug, which colored anodizing is indicative of the heat range of the glow plug.

In accordance with one aspect of the invention, there is provided a heat range indicative glow plug comprising a glow plug body, a central electrode, and a marker attached to the glow plug body, the marker having a color indicative of a heat range of the glow plug, and constructed to survive the use of the glow plug on a running engine. The marker is preferably an insulating ring, and more preferably an anodized aluminum insulating ring visible from the top of the glow plug.

In accordance with another aspect of the present invention, there is provided a method for constructing a glow plug including a heat range indicative color. The method includes assembling an insulating ring, a central electrode, and glow plug body, wherein the insulating ring has a color indicative of the heat range of the glow plug. The assembled glow plug is positioned with respect to a crimp tool, and a portion of the glow plug body is crimped to retain the insulating ring and central electrode in the glow plug body, wherein at least part of the insulating ring is visible from the top of the crimped glow plug.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Glow plugs used in high performance engines may have one of as many as twelve heat ranges. The heat range of the glow plug must be matched to the fuel used, and other engine parameters to properly perform. During a racing event, due to time constraints, working conditions, etc. an incorrect heat range glow plug may accidentally be installed into an engine. A simple color marker would be useful in identifying glow plug heat ranges, but glow plugs live in a very harsh high temperature environment, and, for example, a plastic ring would quickly melt.

Glow plugs suitable for high performance engines are described in U.S. Pat. No. 6,346,688 for "Glow Plug with Crimp-secured Washer and Method," U.S. Pat. No. 6,696,670 for "Glow Plug with Tightly-fit Electrode," and U.S. patent application Ser. No. 10/781,279 for "Glow Plug," all having the same applicant as the present application. The '688 patent, the '670 patent, and the '279 application are incorporated above by reference. The glow plugs of the '688 patent, the '670 patent, and the '279 application include a washer or insulating ring between a central electrode and an outer electrode (or body). The insulating ring is anodized to provide electrical insulation and is at least partly visible from the top the glow plug. The prior art utilizes colorless anodizing, while the present invention introduces the use of various colors of anodizing, thereby allowing each heat range of glow plug to be identified. The anodizing is preferably approximately 0.0002 inches thick, and is preferably type II anodizing.

Figure 1:
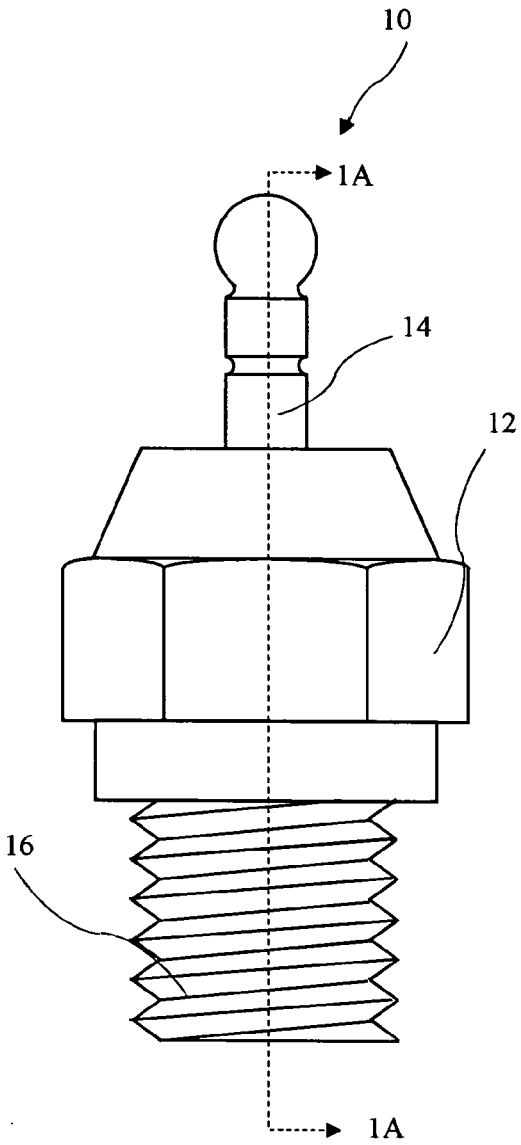
FIG. 1 is a side view of a glow plug according to the present invention.

A side view of a glow plug 10 suitable for exercise of the present invention is shown in FIG. 1. The glow plug 10 includes a glow plug body (or outer electrode) 12, a central electrode 14, and threads 16 for attaching the glow plug 10 to an engine.

Figure 1A:
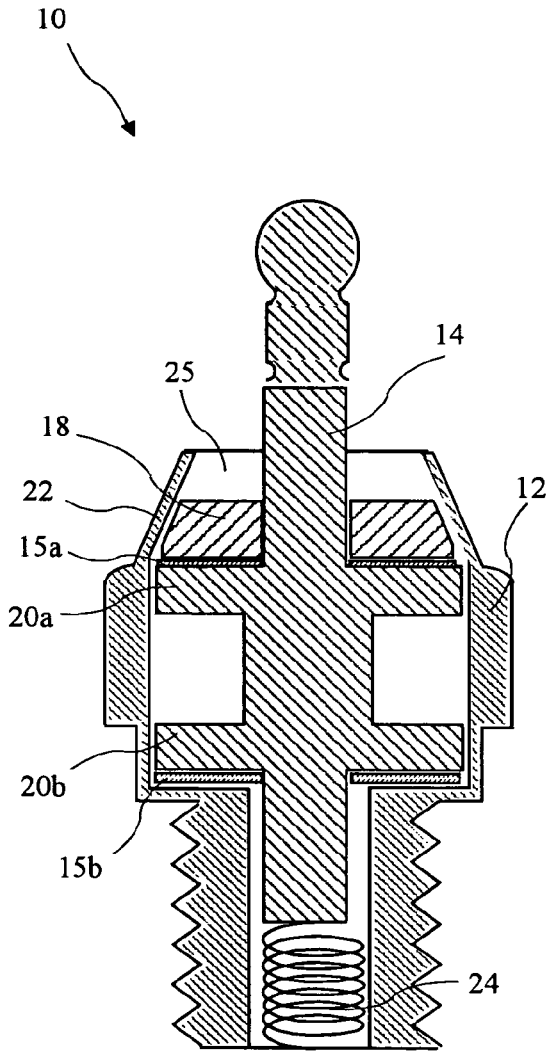
FIG. 1A is a cross-sectional view of the glow plug taken along line 1A—1A of FIG. 1.

A cross-sectional view of the glow plug 10 taken along line 1A—1A of FIG. 1 is shown in FIG. 1A. An insulating ring 18 and a first washer (or upper insulating washer) 15*a* toward the top of the glow plug 10, and a second washer (or lower insulating washer) 15*b* toward the bottom of the glow plug 10, insulate the central electrode 14 from the body 12. The washer 15*a* resides between the insulating ring 18 and a top flange 20*a* of the central electrode 14, and the washer 15*b* resides between a lower flange 20*b* of the central electrode 14 and the body 12 of the glow plug 10. The washer 15*a* is preferably a mica insulator or a ceramic paper insulator or a functionally equivalent material, and is preferably approximately 0.010 inches thick to 0.012 inches thick. The washer 15*b* is preferably a mica insulator or a ceramic paper insulator or a functionally equivalent material and is preferably approximately 0.010 inches thick to 0.012 inches thick.

A heating element 24 is electrically connected between the central electrode 14 and the body 12, and is electrically heated when current flows through the glow plug 10, or is mechanically heated when the glow plug 10 is in a running engine, thereby igniting a fuel air mixture within the engine. A gap 25 is present between the central electrode 14 and the body 12, and the upper insulating ring 18 is at least partly visible from the top of the glow plug 10 through the gap 25, thereby allowing identification of the heat range of the glow plug 10.

Figure 2A:
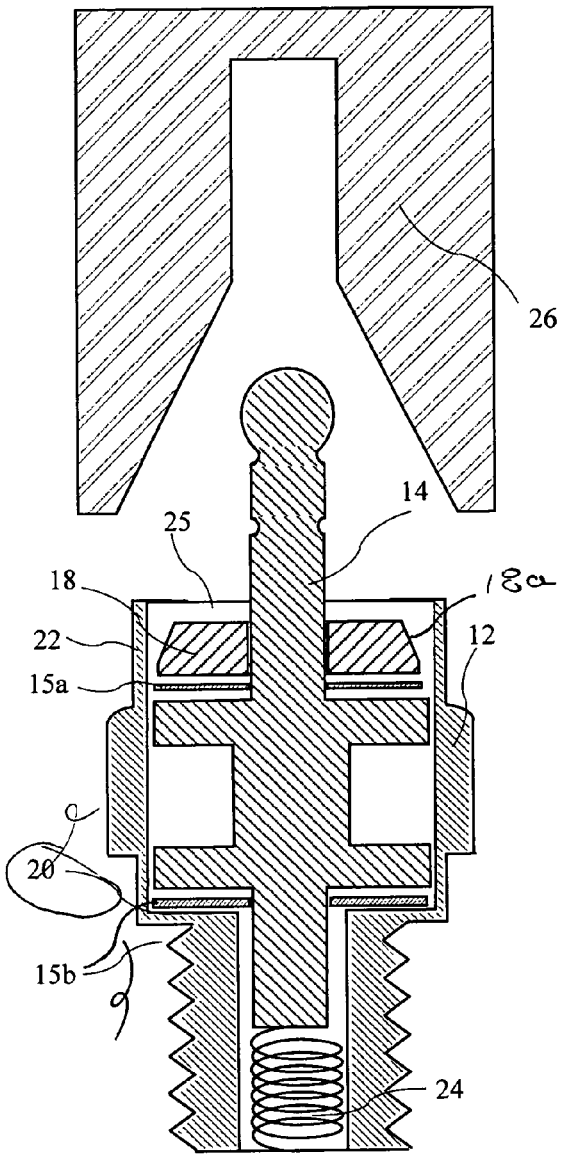
FIG. 2A is a cross-sectional view of the glow plug taken along line 1A—1A of FIG. 1, and a crimping tool, before crimping.

A cross-sectional view of the glow plug 10 taken along line 1A—1A of FIG. 1 and a crimping tool 26 is shown in FIG. 2A. A crimp portion 22 of the body 12 is shown in FIG. 2A before crimping, wherein the crimp portion 22 is approximately cylindrical. The central electrode 14, the insulating ring 18, the washer 15*a*, and the washer 15*b* are shown in a relaxed arrangement, wherein the central electrode 14, the insulating ring 18, the washer 15*a*, and the washer 15*b* may be withdrawn from the body 12, or inserted into the body 12. The insulating ring 23 includes a frustoconical upper edge 18*a*.

Figure 2B:
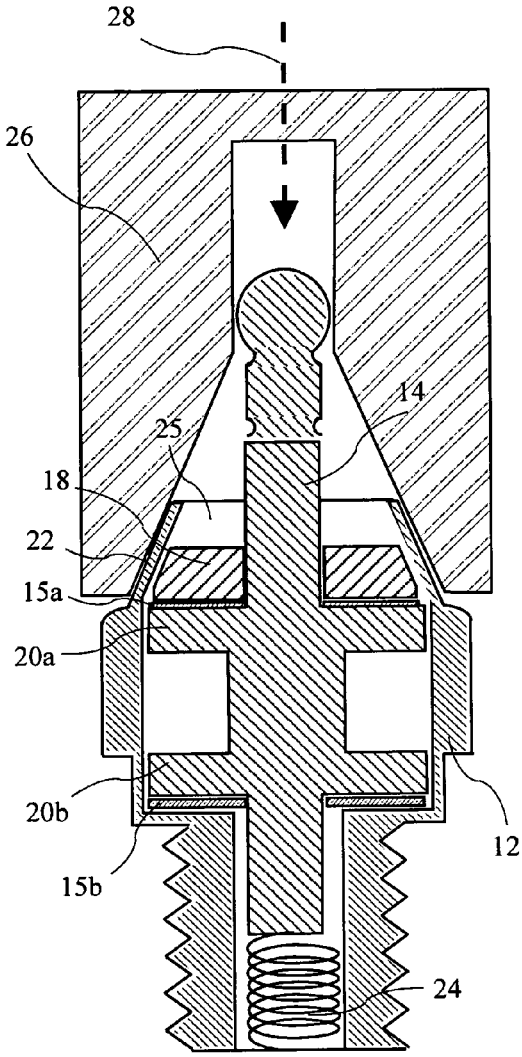
FIG. 2B is a cross-sectional view of the glow plug taken along line 1A—1A of FIG. 1, and a crimping tool, after crimping.

A second cross-sectional view of the glow plug 10 taken along line 1A—1A of FIG. 1, including the crimping tool 26, is shown in FIG. 2B. The crimp portion 22 of the body 12 is shown after crimping by a downward motion of the crimp tool 26 indicated by an arrow 28, wherein the crimp portion 22 is crimped into a conical shape. The central electrode 14, insulating ring 18, upper washer 15*a*, and lower washer 15*b* are shown forced together and into the body 12.

Figure 3:
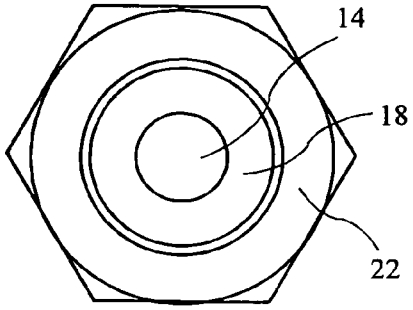
FIG. 3 is a top view of the glow plug having an anodized upper insulating ring.

A top view of the glow plug 10 and the anodized insulating ring 18 is shown in FIG. 3. Following crimping, the gap 25 (see FIG. 1A) remains between the central electrode 14 and the body 12 leaving at least part of the insulating ring 18 visible when looking from the top of the glow plug 10. The insulating ring 18 is preferably a colored metal, and more preferably anodized aluminum. The anodizing is preferably type II anodizing and preferably approximately 0.0002 inches thick.

Although an anodized aluminum upper insulating ring 18 is a preferred marker for indicating the heat range of a glow plug, any marker attached to the glow plug body, the marker having a color indicative of a heat range of the glow plug, and constructed to survive the use of the glow plug on a running engine, is intended to come within the scope of the present invention. Further, U.S. Pat. No. 6,346,688 for "Glow Plug with Crimp-secured Washer and Method," U.S. Pat. No. 6,696,670 for "Glow Plug with Tightly-fit Electrode," and U.S. patent application Ser. No. 10/781,279 for "Glow Plug," describe other variations of glow plugs, and any of these variations which includes a visible colored insulating ring, are intended to come within the scope of the present invention.

Figure 4:
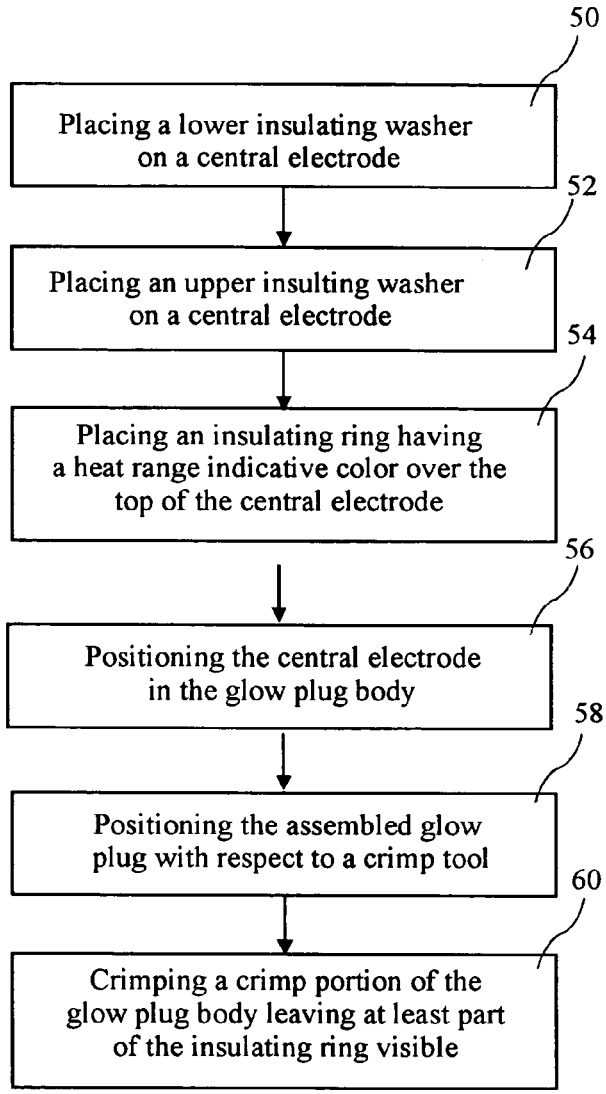
FIG. 4 is a method for constructing a glow plug with a heat range indicative upper insulating ring.

A method for constructing a glow plug 10 with a heat range indicative upper insulating ring 18 is described in FIG. 4. The method comprises the steps of placing a lower insulating washer on a central electrode at 50, placing an upper insulating washer on a central electrode at 52, placing an insulating ring having a heat range indicative color over the top of the central electrode at 54, positioning the central electrode in the glow plug body at 56, positioning the assembled glow plug with respect to a crimp tool at 58, and crimping a crimp portion of the glow plug body to retain the insulating ring, central electrode, and upper insulating ring in the glow plug body at 60. The upper insulating ring 18 has a color indicative of the heat range of the glow plug 10 and is visible from the top of the crimped glow plug, thus providing a quick and easy verification that the correct heat range glow plug is being used in an engine. The glow plug 10 may alternatively be constructed by positioning the lower insulating washer in the glow plug body, inserting the central electrode into the glow plug body, placing the upper insulating washer over the central electrode, placing the insulating ring over the central electrode, and crimping the crimp portion.

While the invention herein disclosed has been described by means of specific embodiments and applications thereof, numerous modifications and variations could be made thereto by those skilled in the art without departing from the scope of the invention set forth in the claims.

I claim:

1. A glow plug comprising:

a glow plug body configured for use in a hobby engine;

a central electrode residing in the glow plug body; and an anodized aluminum insulating ring residing between the central electrode and the glow plug body, the insulating ring having a color indicative of a heat range of the glow plug, and the insulator constructed to survive the use of the glow plug on a running engine, the colored insulating ring at least partly visible looking directly down onto the glow plug.

2. The glow plug of claim 1, wherein the anodizing on the insulating ring is a colored anodizing providing the indicative color to the insulating ring.

3. The glow plug of claim 1, wherein the anodized aluminum insulating ring is anodized using type II anodizing.

4. The glow plug of claim 3, wherein the insulating ring is fabricated from anodized aluminum having type II anodizing approximately 0.0002 inches thick.

5. The glow plug of claim 1, further including a washer between the insulating ring and the central electrode.

6. The glow plug of claim 5, further including a second washer between the central electrode and the glow plug body.

7. The glow plug of claim 1, wherein the insulating ring is held in the glow plug body by a crimped portion of the glow plug body residing over the insulating ring.

8. A method for constructing a glow plug including a heat range indicative anodizing, the method comprising:

assembling a heat range indicative colored insulating ring having a frustoconical upper edge, a central electrode, and glow plug body configured for use in a hobby engine;

positioning the assembled glow plug with respect to a crimp tool;

crimping a crimp portion of the glow plug body into a frustoconical shape residing against the frustoconical upper edge of the colored insulating ring and leaving a gap between the crimp portion and the central electrode, to retain the insulating ring and central electrode in the glow plug body, wherein at least part of the insulating ring is visible through the gap from the top of the crimped glow plug.

9. The method of claim 8, wherein assembling the insulating ring, the central electrode, and the glow plug body further comprises:

placing a lower insulating washer onto the central electrode;

placing an upper insulating washer onto the central electrode;

placing the insulating ring over the top of the central electrode; and placing the central electrode in the glow plug body.

10. The method of claim 9, wherein placing an insulating ring over the top of the central electrode comprises placing the insulating ring fabricated from anodized aluminum over the top of the central electrode.

11. The method of claim 10, wherein placing an insulating ring over the top of the central electrode comprises placing an insulating ring having type II anodizing over the top of the central electrode.

12. A heat range indicative glow plug comprising:

a glow plug body configured for use in a hobby engine;

a central electrode;

a colored insulating ring having a frustoconical upper edge, the insulating ring positioned to electrically insulate the central electrode from the glow plug body, the insulating ring having a color indicative of the heat range of the glow plug;

a crimp portion of the glow plug body formed by crimping a cylindrical portion to form a frustoconical portion, the crimp portion residing over the frustoconical upper edge of the insulating ring; and a gap between the crimp portion and the central electrode wherethrough the colored insulating ring is visible in the completed glow plug.

13. The glow plug of claim 12, wherein the insulating ring is fabricated from anodized aluminum.

14. The glow plug of claim 13, further including a washer residing between the insulating ring and a flange of the central electrode.

15. The glow plug of claim 14, wherein the washer is preferably selected from a set consisting of a mica insulator washer or a ceramic paper insulator washer.

16. The glow plug of claim 12, wherein the colored insulating ring is at least partly visible in a plan view of the glow plug.

17. The glow plug of claim 12, further including an upper washer between the insulating ring and the central electrode and a lower washer between the central electrode and the glow plug body.

18. The glow plug of claim 12, wherein:

the central electrode includes a top flange and a lower flange;

an upper washer resides between the insulting ring and the top flange; and a lower washer resides between the lower flange and the glow plug body.

19. The glow plug of claim 12, wherein;

the central electrode extends above the glow plug body and into the glow plug body; and a heating element is connected between the central electrode and the glow plug body, and resides entirely within the glow plug body, whereby the glow plug is suitable for use in hobby engines.

* * * * *